US010390668B1

(12) United States Patent
Ryder

(10) Patent No.: US 10,390,668 B1
(45) Date of Patent: Aug. 27, 2019

(54) BODY SUPPORT AND POSITIONING APPARATUS AND SYSTEM FOR SEATED-POSITION TOILET USE

(71) Applicant: Robert F. Ryder, Ripon, CA (US)

(72) Inventor: Robert F. Ryder, Ripon, CA (US)

( * ) Notice: Subject to any disclaimer, the term of this patent is extended or adjusted under 35 U.S.C. 154(b) by 0 days.

(21) Appl. No.: 15/936,501

(22) Filed: Mar. 27, 2018

Related U.S. Application Data

(60) Provisional application No. 62/477,682, filed on Mar. 27, 2017.

(51) Int. Cl.
*A47K 17/02* (2006.01)
*A47K 17/00* (2006.01)

(52) U.S. Cl.
CPC ..... *A47K 17/028* (2013.01); *A47K 2017/006* (2013.01)

(58) Field of Classification Search
CPC ..... A47K 17/028; A47K 2017/006
USPC ..... 4/254, 667
See application file for complete search history.

(56) References Cited

U.S. PATENT DOCUMENTS 3,619,820 A * 11/1971 Cain et al. ..... A47K 17/028 4/254
4,584,725 A 4/1986 Oliver
5,809,583 A 9/1998 Pucciani
2013/0067649 A1* 3/2013 Rane ..... A47K 17/028 4/254
2015/0113719 A1 4/2015 Good
2018/0168412 A1* 6/2018 Pham ..... A47K 17/028

FOREIGN PATENT DOCUMENTS

CN 203716257 U 7/2016

* cited by examiner

*Primary Examiner* — Tuan N Nguyen
(74) *Attorney, Agent, or Firm* — Charles L. Thoeming

(57) ABSTRACT

A body support and positioning apparatus and system for seated-position toilet use provides two levers, two stanchions, a platform, a crosspiece, two stop and release mechanisms, each providing a swinging support strut, a hinge to allow pivoting motion about the hinge, a flexible wire segment, a stiff wire segment, and a trigger mechanism. An embodiment of the apparatus and system is configured about the sides and front of a toilet to provide a body support system for squatting into a position for optimal bowel movement evacuation. Embodiments of the apparatus and system provide adjustable stanchion height and assembly, as well as varied platform, crosspiece, and support strut combinations.

11 Claims, 9 Drawing Sheets

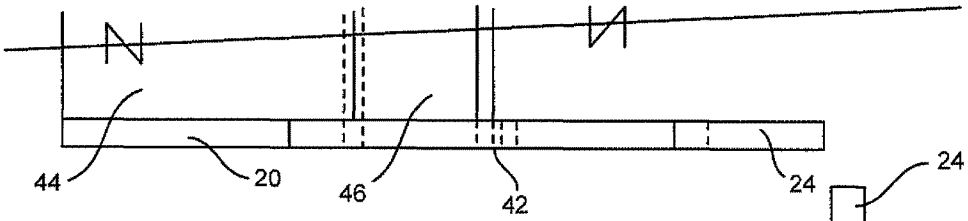
FIG. 5
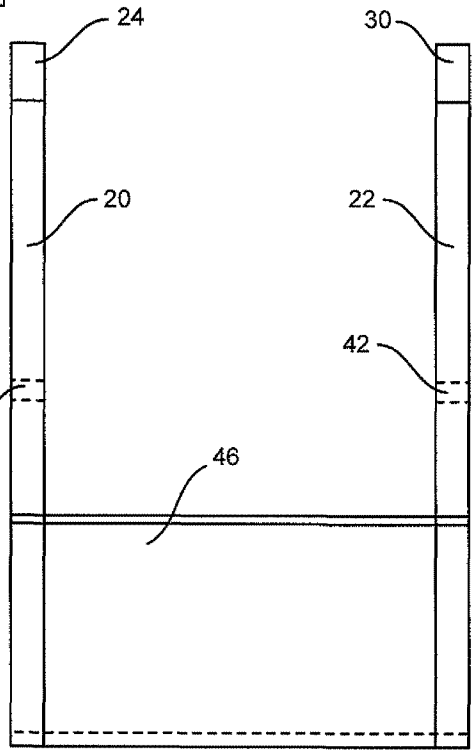
FIG. 6
FIG. 7

BODY SUPPORT AND POSITIONING APPARATUS AND SYSTEM FOR SEATED-POSITION TOILET USE

CROSS-REFERENCES TO RELATED APPLICATIONS

This United States non-provisional patent application is based upon and claims the filing date of U.S. provisional patent application Ser. No. 62/477,682, filed Mar. 27, 2017.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BT-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

STATEMENT REGARDING COPYRIGHTS/TRADEMARKS

Portions of the disclosure of this patent document contain material which is subject to copyright/trademark protection. The copyright/trademark owner has no objection to the facsimile reproduction by anyone of the patent document or the patent disclosure, as it appears in the United States Patent and Trademark Office patent file or records, but otherwise reserves all copyright and trademark rights whatsoever.

BACKGROUND OF THE INVENTION

Field of the Invention

This invention relates to providing improved body positioning systems. More particularly, this invention relates to an apparatus and system providing elevated support and positioning of the feet to place the body of a user in a posture facilitating bowel elimination during seated-position toilet use.

DESCRIPTION OF RELATED ART INCLUDING INFORMATION DISCLOSED UNDER 37 CFR 1.97 AND 1.98

Having one's feet resting on a 7" to 9" high stool while sitting on a toilet facilitates colon evacuation. However, when wearing clothes, it is cumbersome to manipulate the stool into position in front of the toilet and then to lift your feet up onto the stool when your pants and underpants are down around your ankles. Some people have difficulty raising their feet up upon a stool from a sitting position even when they have no clothes on. This is particularly true for the elderly.

Further, it is also cumbersome to place your feet back onto the floor and then move the stool out of the way. The body support and positioning apparatus and system for seated-position toilet use simplifies these actions and requires less effort.

BACKGROUND OF THE INVENTION

The users of western-style toilets are usually seated in a chair-like position, which represents a significant departure from the squatting position used by humans for most of their existence. Historically, humans have used a natural squatting position that places the femurs of the upper legs canted at an upward angle. This more ideal body position has several advantages, including: proper alignment of the lower gastrointestinal tract, better utilization of the abdominal muscles, and reduced strain on the sphincter muscles.

Until conventional western-style toilets are replaced by more biomechanically-compatible fixtures, a need exists for an inexpensive and useful means for beneficially positioning a user's body in a posture facilitating bowel elimination during seated-position toilet use.

BRIEF SUMMARY OF THE INVENTION

Accordant with the body support and positioning apparatus and system for seated-position toilet use, the user first maneuvers their body to face forward while standing on the platform or partially so. They then lower their pants and underpants and sit down on the toilet seat with their feet resting on the platform.

The user now reaches back at their sides at about waist height and grasps the lever handles, one in each hand. By pushing down on the handles, the applied pressure causes the platform to swing upward in an arc. As the platform and levers arc upward, swinging support struts swing to a vertical position.

At this point the user allows the lever handles to rise slightly so the swinging support struts will lower a small distance until the bottom of each support strut contacts the floor. With the swinging support struts now in a vertical position supporting the platform, the platform, the levers, and the crosspiece are at the desired height for proper body positioning.

The platform and crosspiece come together to form an obtuse angle or opened "V" shape. The user will slide their feet backward a short distance until their feet are partially resting on the platform and partially resting on the crosspiece. At this point the user continues to slide their feet backward until they reach the best position to facilitate evacuation.

Once the bowel movement is completed, the user lowers the platform by first pushing down slightly on the lever handles which raises the swinging support struts slightly off the floor. The user then pulls back on the spring-loaded triggers which are attached to each lever handle. This action pulls the swinging support struts back to a diagonal position. Now the user allows the lever handles to rise until the platform arcs down to the floor which is its original position.

As the platform lowers, the bottom ends of the swinging support struts will slide backward along the floor. Also, as the platform lowers to the floor, the user's feet will easily slide onto the platform. After the user completes the paper work, the user can now stand, pull up their underpants and pants, flush the toilet and walk away.

BRIEF DESCRIPTION OF THE SEVERAL VIEWS OF THE DRAWINGS

The accompanying drawings which are incorporated into and constitute a part of the description of the body support and positioning apparatus and system for seated-position toilet use, illustrate embodiments of the invention and explain the principles of the invention. It is to be understood, however, that the drawings are designed for the purposes of illustration only, and not as a definition of the limits of the invention for which reference should be made to the claims.

FIG. 5 depicts a partial top planar view of the lever, platform and crosspiece elements of the embodiment of the body support and positioning apparatus and system for seated-position toilet use 10 of FIG. 1.

FIG. 6 depicts a left-side planar view of the lever, platform and crosspiece elements of the embodiment of the body support and positioning apparatus and system for seated-position toilet use of 10 FIG. 1.

FIG. 7 depicts a front planar view of the lever, platform and crosspiece elements of the embodiment of the body support and positioning apparatus and system for seated-position toilet use of 10 FIG. 1.

DETAILED DESCRIPTION OF THE INVENTION

Figure 1:
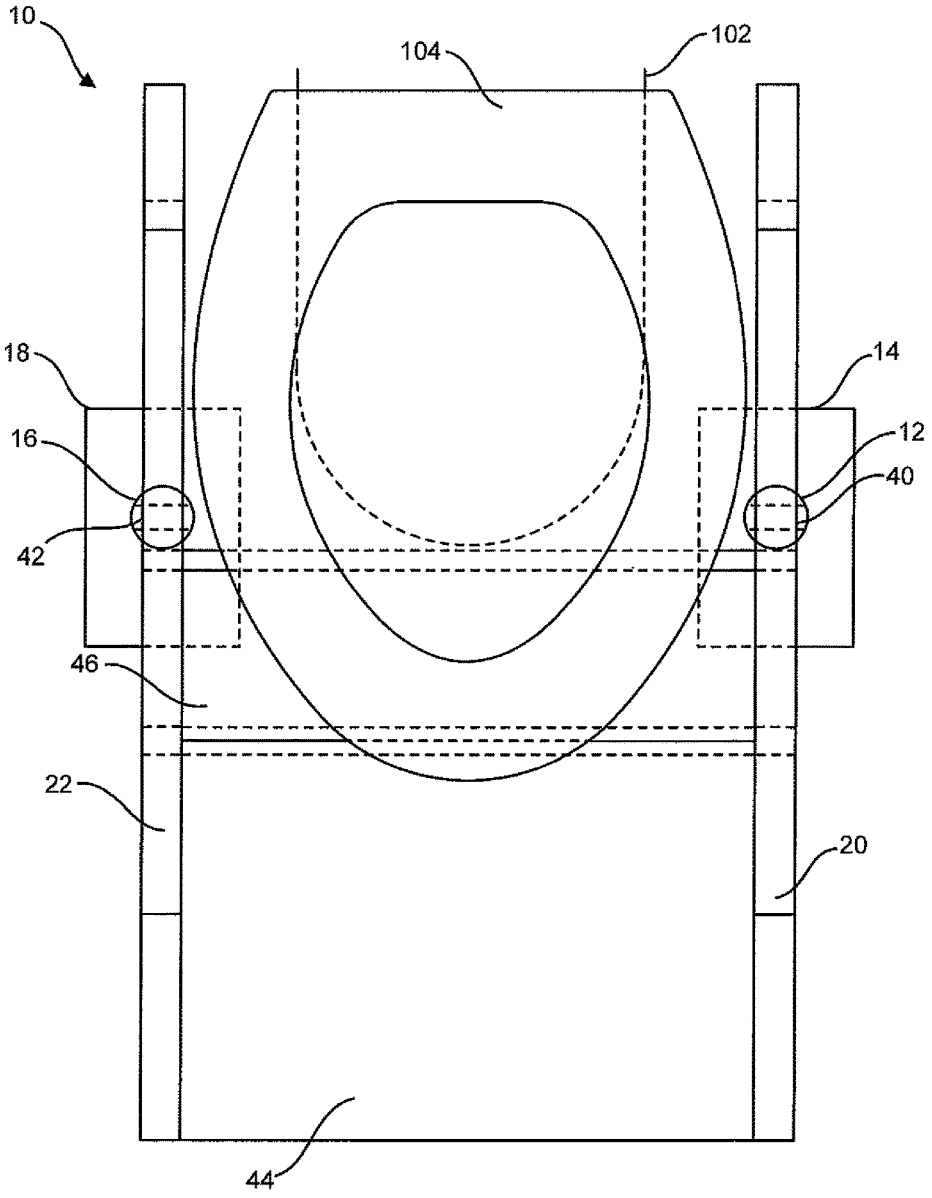
FIG. 1 depicts a top planar view of selected elements for an embodiment of the body support and positioning apparatus and system for seated-position toilet use 10 positioned around the front and sides of a toilet.

The main components for an embodiment of the body support and positioning apparatus and system for seated-position toilet use 10 are two identical, equal sized levers, 20 and 22, which are oriented parallel to one another, FIGS. 1-7. The distance between the parallel oriented levers is slightly greater than the width of the toilet bowl seat 104 at its widest point. There is an equal sized lever, 20 and 22, on each side of the toilet base 102 and toilet seat 104. The equal sized levers, 20 and 22, each have a lever bottom portion, a lever top portion, and an angled central lever element of equal size to be received into and held by a stanchion slot opening, and having an aperture at or near midway on the angled central lever element, the aperture sized to correspond to a stanchion fulcrum aperture and to receive a bolt or pin at or near the angled central lever element longitudinal mid-point. Top portions of two equal sized stanchions, 12 and 16, have apertures in them so that the corresponding equal sized lever aperture at or near each central lever element longitudinal mid-point can be matched-up to a corresponding equal sized stanchion aperture so that a fastener assembly can be inserted in the matched and corresponding apertures. This allows each lever to pivot on a separate stationary stanchion, and to be thus secured by the stanchion and fastener assembly. Thus, when each equal sized lever, 20 and 22, is received in its respective stanchion slot opening, the two equal sized levers, 20 and 22, provide two-parallel, equal sized levers orientated to each other on either side of the toilet base 102 and separately positioned stanchions, 12 and 16. It is understood the location of the aperture midway on the angled central lever element can be an approximate location from the exact midway point of the angled central lever, depending on the spacing requirements of the particular body support and positioning apparatus and system for seated-position toilet use 10 and the corresponding fulcrum, 40 and 42, for each lever-stanchion assembly. It is further understood that the aperture in each angled central lever element is of equal size as the stanchion fulcrum aperture and is aligned to correspond with the stanchion fulcrum aperture. When the fulcrum location for the angled central lever changes longitudinally, one way or the other, the amount of lever arcing at one end becomes different from the amount at the other end while the force required at the handle end to arc the platform upward also changes to be more or less. Therefore, having some latitude in the location of the fulcrum on the angled central lever allows the apparatus to be produced to provide optimal comfort and ease of operation for the user.

The location of the pivot point on each stanchion, 12 and 16, is the fulcrum, 40 and 42, for each lever-stanchion assembly. The location of the fulcrums, 40 and 42, can be moved forward or backward by sliding the stanchions forward or backward. The stanchion fulcrum can be raised or lowered by adjusting the height of alternative adjustable stanchions, 48 and 82, FIGS. 14-16 and 11-13, respectively. Each stanchion, 12 and 16, provides a stanchion vertical element bottom portion orthogonally disposed and affixed to, and supported by, a stanchion base, 14 and 18, respectively, positioned on the floor on either side of the toilet base 102, FIGS. 1-3, such that the stanchion vertical elements are orthogonally disposed to the floor. Similarly, each adjustable stanchion, 48 and 82, is supported by an adjustable stanchion base, 54 and 84, respectively, FIGS. 11-16, and can similarly be positioned on the floor on either side of the toilet base 102 (not depicted). It is understood that all disclosed stanchion bases also may be raised by placing a thickness of support material between the base bottom and the floor, the preferred material for such purpose being equal and even thicknesses of rigid rubber (not depicted). Stanchions, 12, 18, 48, and 82 comprise top portions having a stanchion slot opening and a stanchion fulcrum aperture through stanchion sides on the stanchion slot opening FIGS. 1-7, 9-16. Thus, when each equal sized lever, 20 and 22, is received in its respective stanchion slot opening, the two equal sized levers, 20 and 22, provide parallel orientation to each other with respect to the toilet base 102 and positioned stanchions, 12 and 16, see e.g., FIGS. 1, 3 and 7, providing two parallel oriented equal sized levers, 20 and 22.

Figure 3:
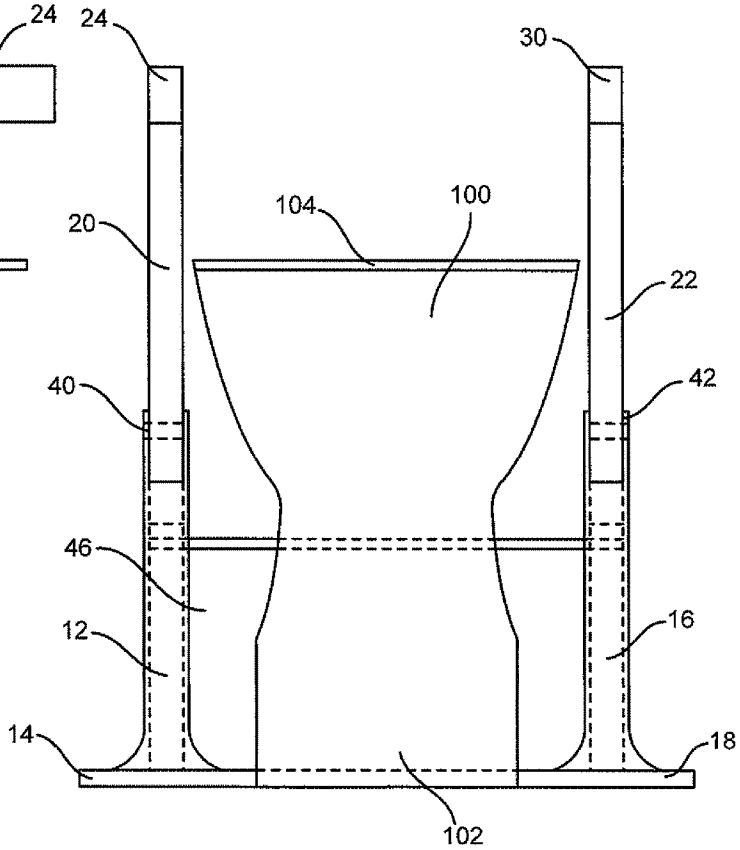
FIG. 3 depicts a rear planar view of the embodiment of the body support and positioning apparatus and system for seated-position toilet use 10 of FIG. 1.

The platform 44 is either affixed to the parallel oriented levers, 20 and 22, or is an integral part of them, FIGS. 1, 3, and 7. The platform 44 secures the two levers, 20 and 22, so they are a fixed distance apart.

Likewise, the crosspiece 46 is either affixed to the parallel oriented levers, 20 and 22, or is an integral part of them, above the platform 44, FIG. 1. The crosspiece 46 bottom edge is adjacent to the back edge of the platform 44 and the crosspiece 46 top edge is below the fulcrums, 40 and 42, FIGS. 1, 3, and 7. The crosspiece 46 adds structural rigidity and stability to the two parallel oriented levers, 20 and 22, FIGS. 1, 3 and 7. The crosspiece 46 also serves as a foot rest when the platform 44 is raised up to the stop position.

There is a lever, 20 and 22, on each side of the toilet seat 104 and base 102 and each lever, 20 and 22, is supported by a fixed stanchion, 12 and 16, respectively, or adjustable stanchions, 48 or 82, such that the platform 44 rests on the floor near the front of the toilet base 102 and the lever handles, 24 and 30, are at the upper end of the levers, 20 and 22, near the rear of the toilet seat 104, FIGS. 1-3, 11-16.

Figure 2:
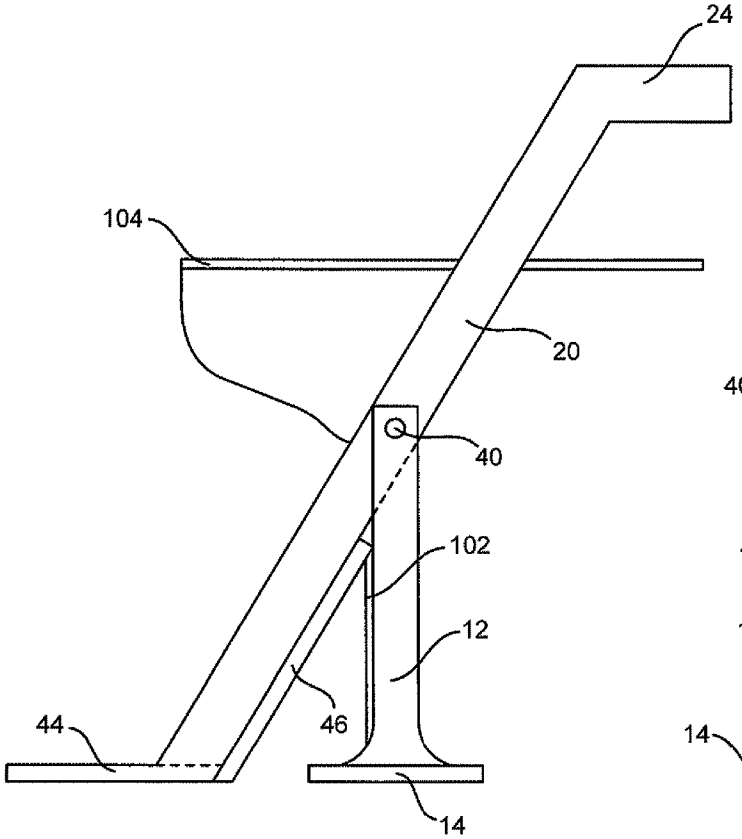
FIG. 2 depicts a left-side planar view of the embodiment of the body support and positioning apparatus and system for seated-position toilet use 10 of FIG. 1.

In the resting position, the platform 44 is flat on the floor with the back end of the platform 44 being near the vertical front edge of the toilet base 102, FIGS. 1-3. The upper ends of the levers, 20 and 22, which are the handles, 24 and 30, are easily reachable by a person who is sitting on the toilet seat 104 and reaching backward at about waist level. When these handles, 24 and 30 are simultaneously pushed downward, the platform 44 swings upward in an arc, e.g., FIGS. 2, 9, and 10.

There is a stop and release mechanism incorporated on each side for an embodiment of the body support and positioning apparatus and system for seated-position toilet use 10, FIGS. 4-8. A vertical swinging support strut 36 on each parallel oriented lever side 20 and 22 serves as a stop and support strut by automatically swinging down by gravity to a vertical position against the floor as the platform 44 swings upward to the desired position.

The platform 44 is released from this position when the trigger on a trigger device that is attached to each lever, 20 and 22, just below the handles, 24 and 30, is pulled back. This action causes the swinging support strut 36 to be pulled back and to slide back along the floor as the platform 44 is lowered to the floor, FIG. 4.

Each stop and release mechanism provides: 1) a swinging support strut 36 that deploys down by gravity drawing flexible wire segment 28 taught and is repositioned by pulling a spring activated trigger assembly 26; 2) a hinge 62 that serves to connect the end of the swinging support strut 36 to the bottom and outer edges of the crosspiece 46 attachment to each lever; 3) a flexible wire segment 28 having a flexible wire first end and a flexible wire second end, the flexible wire first end attached to a back side of the vertical swinging support strut 36 the near a longitudinal middle portion of the vertical swinging support strut 36, the flexible wire second end attached to the stiff wire segment 80 that extends up along the lever to the handle; 4) the stiff wire segment 80 having a first end and a second end, the stiff wire segment first end connected to the flexible wire segment 28 and the stiff wire segment second end connected to the spring loaded trigger assembly 26 attached to each lever, 20 and 22, just below the handles, 24 and 30, and 5) a spring loaded trigger 26 assembly that when engaged, activates the stiff wire segment 80 and taught flexible wire segment 28 to return the vertical swinging support strut 36 back and allowing the weight bearing bottom end of each vertical swinging support strut 36 to slide backward along the floor as each lever, 20 and 22, and the platform 44 are lowered to the resting position on the floor, FIGS. 2, 4, 8, and 10.

The body support and positioning apparatus and system for seated-position toilet use 10 has a platform 44 about the width of the toilet seat positioned flat on the floor in front of the toilet, FIG. 1. The top surface of the platform 44 is low enough and is tapered at the edges sufficiently so it is not a hindrance when standing on it and positioning yourself to sit on the toilet. Once sitting on the toilet, the user's feet will rest on the platform 44, FIG. 10.

Levers, 20 and 22, extend at an upward angle from the rear corners of the platform, FIGS. 2-7, 9 and 10. The levers, 20 and 22, angle diagonally upward and back along the side of the toilet and ends a few inches above and close to the side of the rear of the toilet seat 104. The angle of the levers, 20 and 22, is about 60 degrees with the floor. The upper ends of the levers, 20 and 22, provide handles, 24 and 30, respectively, which the user can easily grasp by moving their hand backward at their side at about waist level. Pushing down on the handles', 24 and 30, at the ends of the levers, 20 and 22, causes the platform to rise in an arcing motion, FIGS. 2, 4, and 10.

Stanchions, 12 and 16, are positioned on each side of the toilet base 102, FIGS. 1-3, 11-16. An aperture in the top of each stanchion, 12 and 16, is aligned with the aperture near the longitudinal mid-point of each respective lever, 20 and 22. A pin or bolt goes through both apertures such that each lever, 20 and 22, pivots on its respective stanchion, 12 and 16, at either side of the toilet. These pivot points are fulcrums, 40 and 42 for each respective lever, 20 and 22.

Embodiments of the body support and positioning apparatus and system for seated-position toilet use 10 provide an adjustable stanchion arm 48 and an adjustable vertical stanchion 82, FIGS. 11-16.

Figure 14:
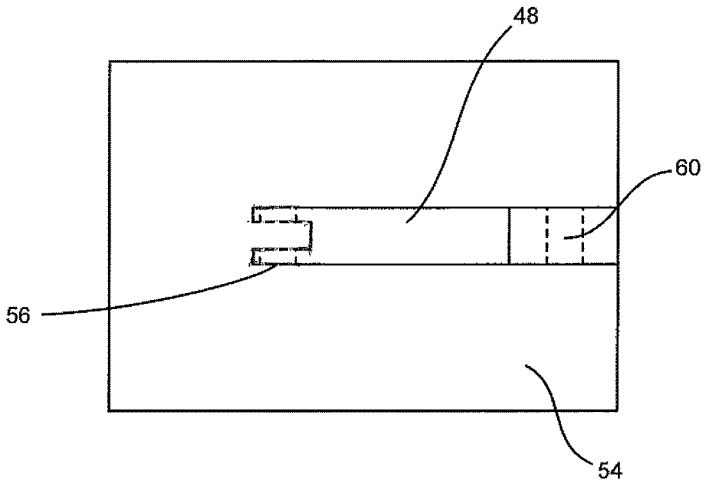
FIG. 14 depicts a top planar view of an alternative adjustable stanchion element for an embodiment of the body support and positioning apparatus and system for seated-position toilet use 10.
Figure 15:
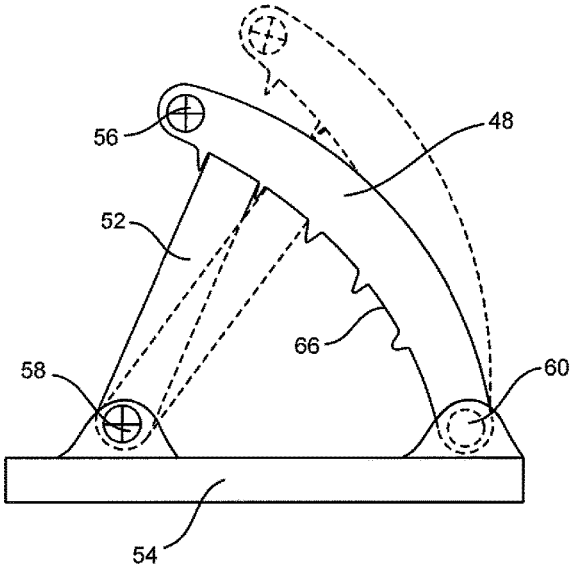
FIG. 15 depicts a left-side planar view of the stanchion element of FIG. 14.
Figure 16:
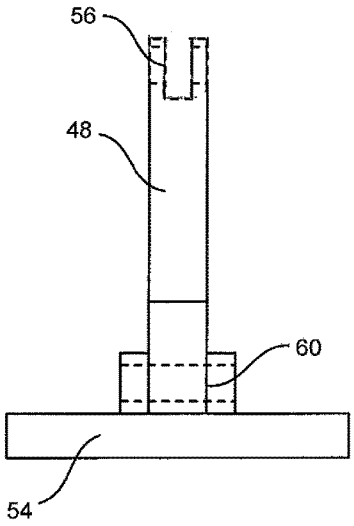
FIG. 16 depicts a rear planar view of the stanchion element of FIG. 14.

An adjustable stanchion arm 48 includes an adjustable stanchion fulcrum 56, and a base 54 with a first adjustable stanchion base hinged assembly and a second adjustable stanchion base hinged assembly, 58 and 60, respectively, FIGS. 14-16. A locking pin 50 is sized to have a first locking pin end received by and move about the first adjustable stanchion base hinged assembly 58. A second locking pin end is sized to fit into and be received by one of a plurality of equally spaced gaps on the inside concave portion of the adjustable stanchion arm 48. Adjusting the locking pin 50 within lower gaps on the inside concave portion of the adjustable stanchion arm 48, for a pair of adjustable stanchion arms 48 of equal sized adjustable stanchions positioned on either side of the toilet, causes the adjustable stanchion arms 48 to arc upwards from its end attached to the second adjustable stanchion base hinged assembly 60, and adjustably raises the adjustable arm fulcrum 56 position from the base 54. This action to raise the adjustable arm fulcrum 56 provides a range of fulcrum positions adaptable to two parallelly oriented levers, 20 and 22. The levers, 20 and 22, each have an angled central element sized to be received into and held by an adjustable stanchion arm 48 adjustable slot, and providing an aperture sized to correspond to the adjustable stanchion arm fulcrum 56 aperture and aligned to correspond with the adjustable stanchion arm fulcrum 56 aperture, and to receive a fastener assembly at or near the lever, 20 and 22, longitudinal mid points. By this arrangement, each lever is received into an adjustable stanchion arm 48 slot opening, the levers 20 and 22, provide parallel orientation to each other with respect to the toilet base 102. The adjustable fulcrum 56 aperture is sized so that the aperture in each of the levers can be matched-up to and correspond thereto and receive a fastener assembly inserted in the matched and corresponding apertures. This allows each lever, 20 and 22, to pivot on a separate stationary adjustable stanchion arm fulcrum 56. Accordingly, two equal sized adjustable stanchion arms 48 are positioned on either side of a toilet base 102 and toilet seat 104 to provide support for the necessary range of motion for two equal sized levers, 20 and 22, for beneficially positioning a user's body in a posture facilitating bowel elimination during seated-position toilet use FIG. 10.

Figure 11:
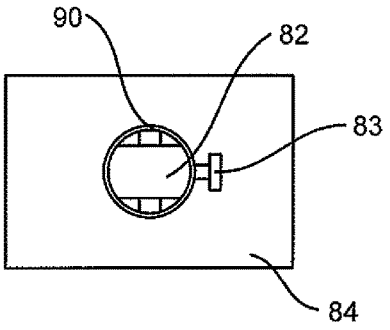
FIG. 11 depicts a top planar view of an alternative adjustable stanchion element for an embodiment of the body support and positioning apparatus and system for seated-position toilet use 10.
Figure 12:
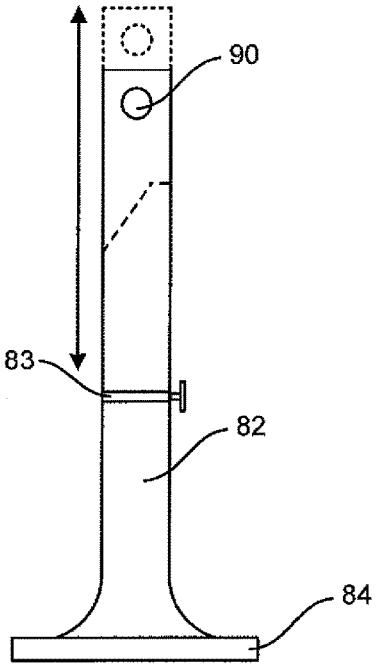
FIG. 12 depicts a left-side planar view of the stanchion element of FIG. 11.
Figure 13:
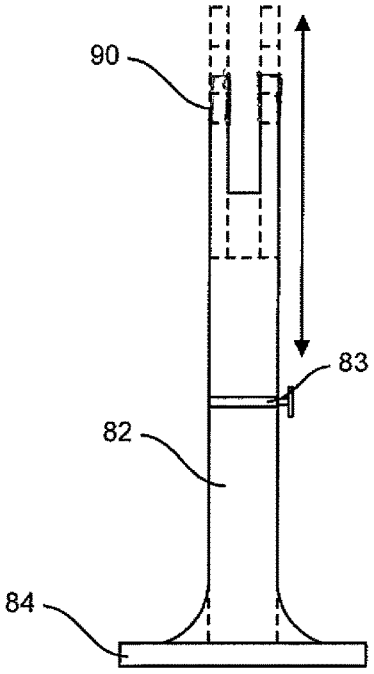
FIG. 13 depicts a rear planar view of the stanchion element of FIG. 11.

Adjustable vertical stanchion 82 provides a stanchion first telescoping vertical element and a stanchion second telescoping vertical element, each telescoping vertical element having top and bottom portions, and further includes an adjustable fulcrum 90, and a base 84, FIGS. 11-12. Each vertical stanchion first telescoping vertical element bottom portion is fixedly attached to the base 84. Adjusting the releasable, locking assembly 83 between the adjustable stanchion first telescoping vertical element top portion and the adjustable stanchion second telescoping vertical element bottom portion for a pair of equal sized adjustable stanchions 82 positioned on either side of the toilet, disposed orthogonally to the floor, raises the second telescoping vertical element top portion and adjustable fulcrum 90 position orthogonally from the base 84, providing a range of fulcrum positions adaptable to two parallelly oriented levers, 20 and 22, each separately affixed to an adjustable stanchion 82. Thus, the releasable, locking assembly 83 permits the stanchion second telescoping vertical element to extend to a desired position and secure the stanchion second telescoping vertical element in the desired position above the stanchion first telescoping vertical element. The levers, 20 and 22, each have an angled central element sized to be received into and held by an adjustable stanchion slot opening of each equal sized adjustable stanchion, and having an aperture sized to correspond to the adjustable fulcrum 90 and to receive a fastener assembly at or near the lever longitudinal mid points. The top portion of the second telescoping vertical element has an adjustable fulcrum 90 having an aperture sized so that the aperture in each of the levers, 20 and 22, can be matched-up to and correspond with the aperture in the top portion of the second telescoping vertical element of the stanchions, so that a fastening assembly can be inserted in the matched and corresponding apertures.

Figure 4:
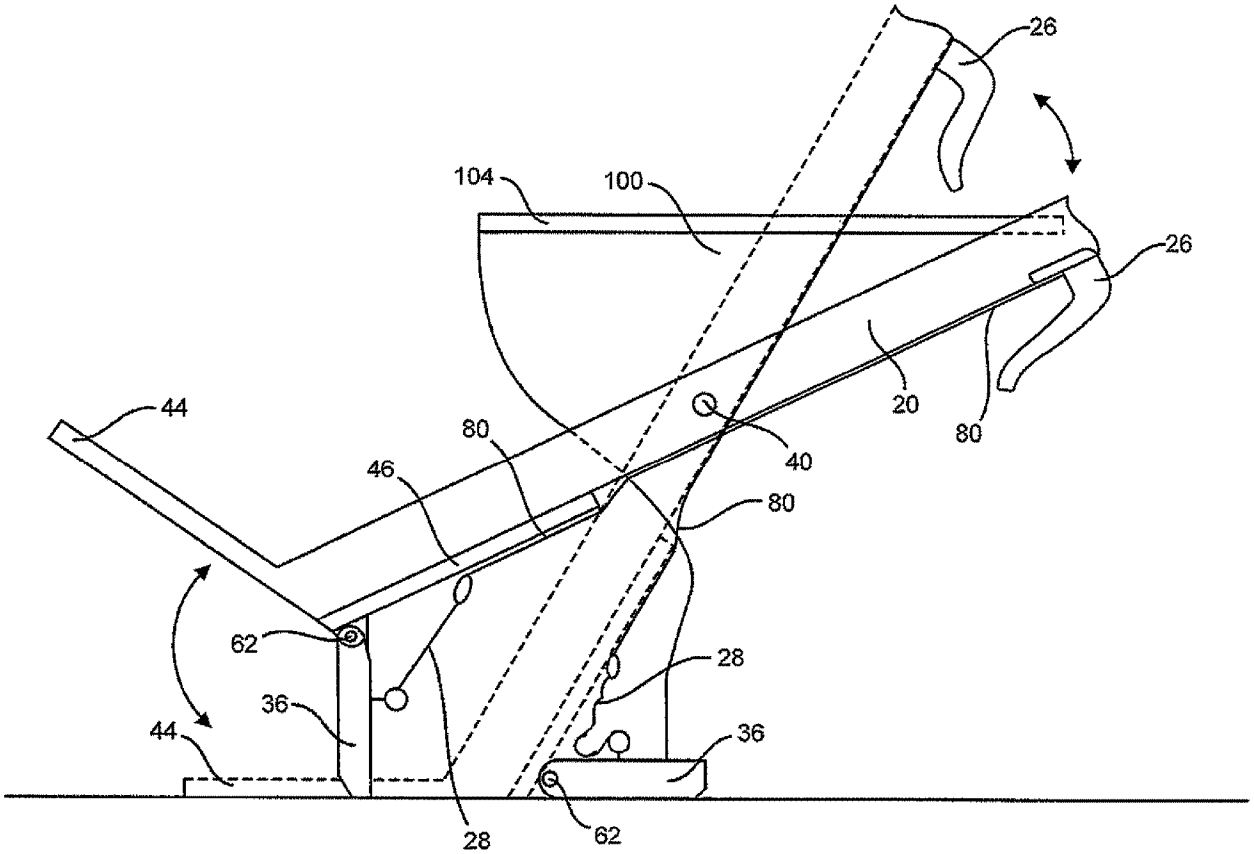
FIG. 4 depicts a left-side planar view of selected elements of the embodiment of the body support and positioning apparatus and system for seated-position toilet use 10 of FIG. 1 and further includes elements of the stop and release mechanism associated with the apparatus with varied positions for the body support and positioning apparatus and system for seated-position toilet use 10.
Figure 8:
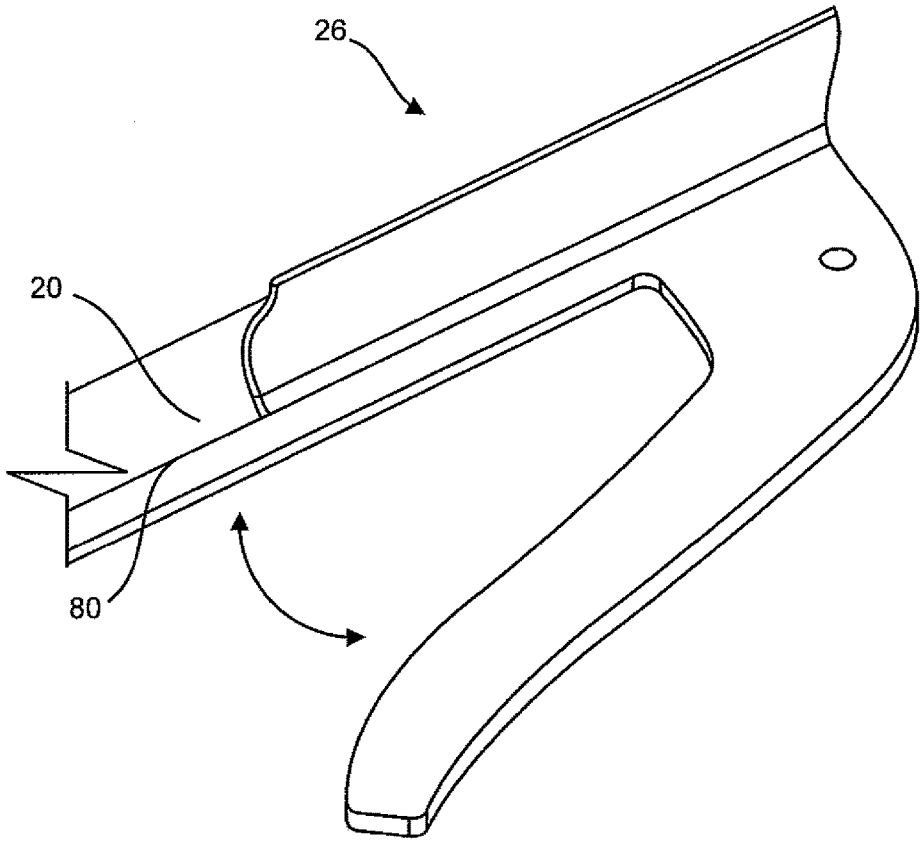
FIG. 8 depicts a perspective view of the trigger assembly for embodiments of the body support and positioning apparatus and system for seated-position toilet use 10.
Figure 9:
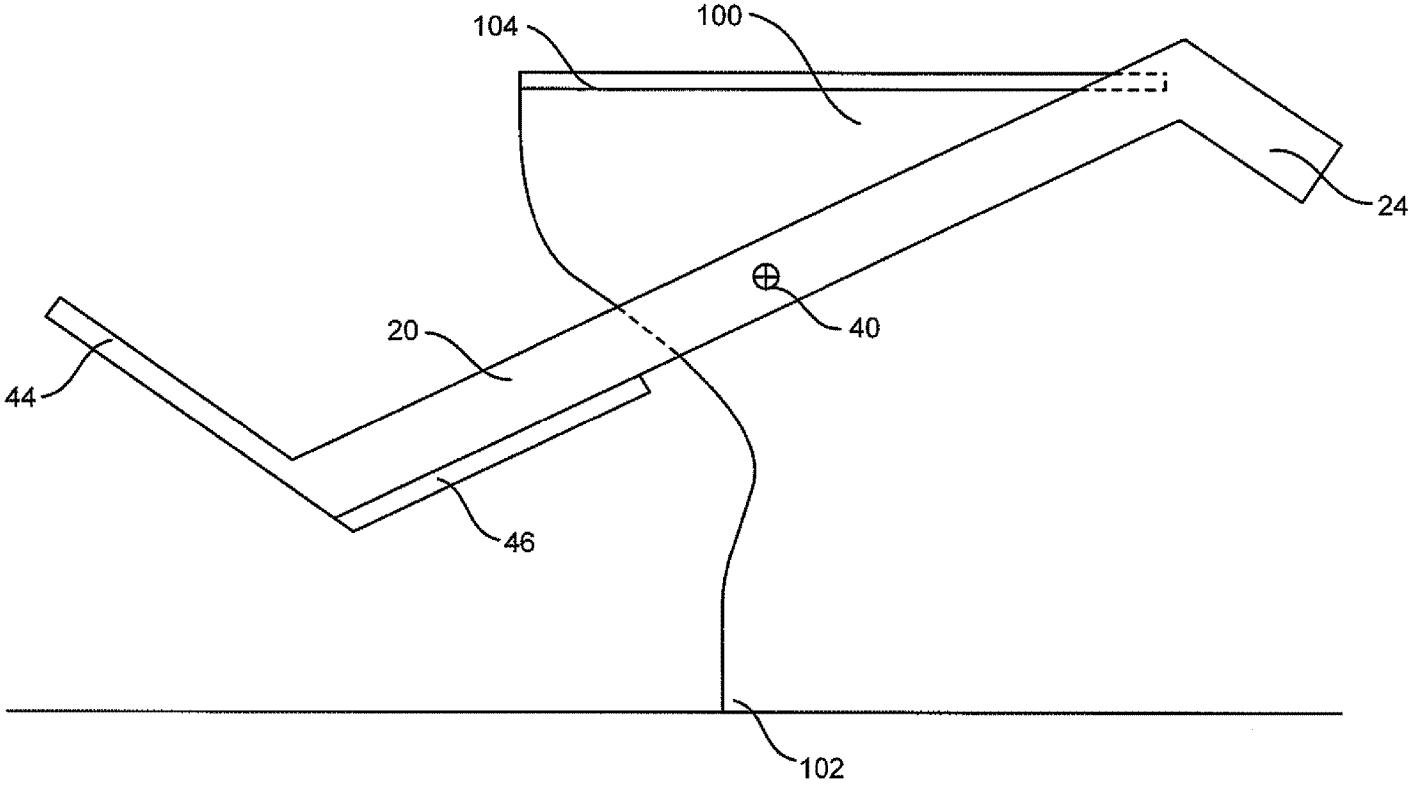
FIG. 9 depicts a left-side planar view of selected elements of the embodiment of the body support and positioning apparatus and system for seated-position toilet use 10 of FIG. 1, with the lever, platform and crosspiece elements the apparatus raised for use.
Figure 10:
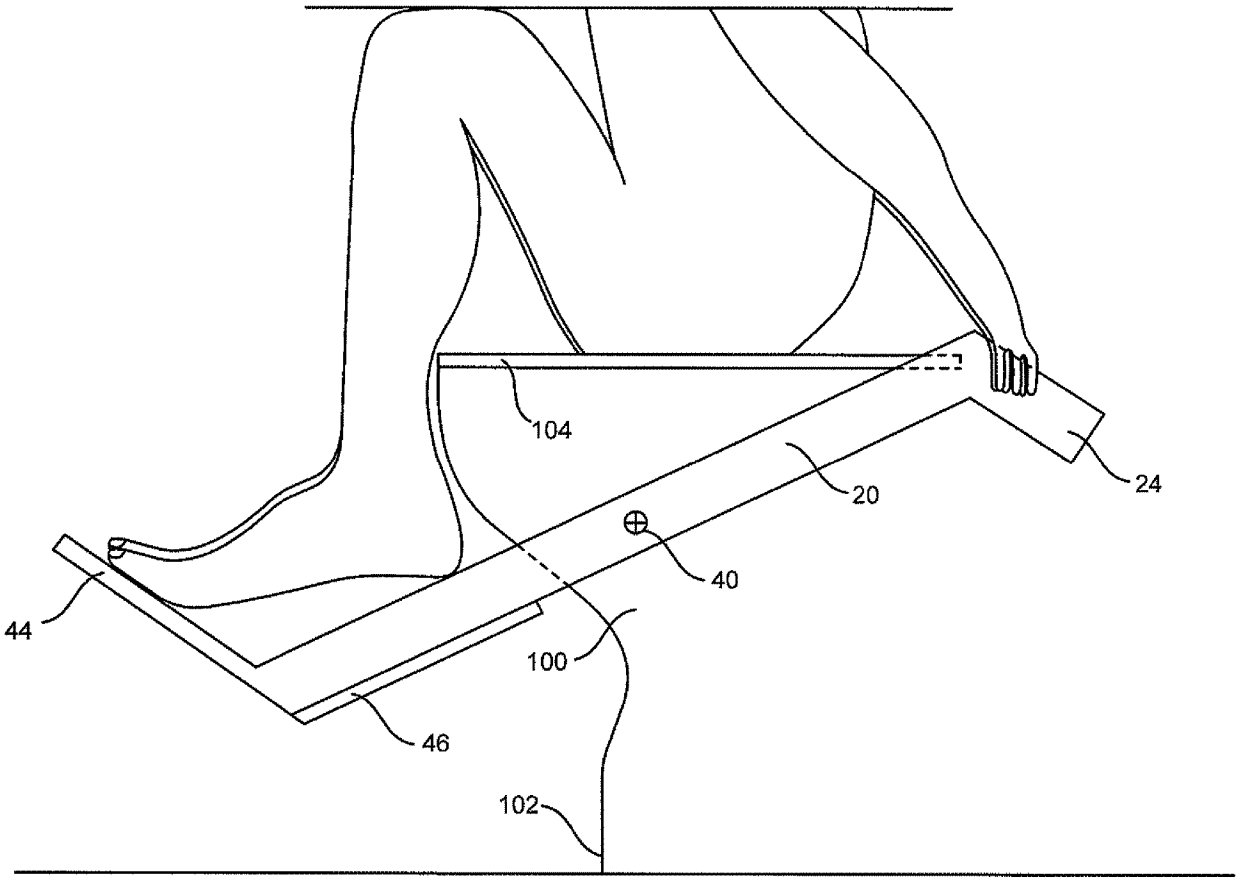
FIG. 10 depicts the embodiment of the body support and positioning apparatus and system for seated-position toilet use 10 of FIG. 1, with a user positioned for use of the same.

The two stop and release mechanisms provide vertical swinging support struts 36, FIG. 4. Hinges connect the vertical swinging support struts 36 to the backside of the crosspiece 46 attachment to each equal sized lever near the bottom corners, one on each side of the crosspiece 46. There can be a tie-rod or bungee cord connecting these vertical swinging support struts 36 hingeably attached to the crosspiece 46 to insure the vertical swinging support struts 36 move into support position in unison (not depicted).

When the platform 44 is resting on the floor, the vertical swinging support struts 36 extend backward from the crosspiece 46 along the sides of the toilet and the vertical swinging support struts 36 rest on the floor. When the user pushes down on the equal sized lever handles, 24 and 30, the bottoms of the equal sized levers, 20 and 22, arc upwards and the vertical swinging support struts 36 swing from the hinges 62 downward from the crosspiece 46 position to the floor due to the force of gravity, FIG. 4, to vertically support the platform 44 and crosspiece 46 at a desired height above the floor surface. When the edge rises high enough, the vertical swinging support struts 36 swing down into a vertical position such that when the user releases the lever handles, the vertical swinging support struts 36 bear the weight of the platform 44, crosspiece 46, levers 20 and 22, and the force exerted by the user's feet, FIG. 4. The vertical swinging support struts 36 are sized such that in the vertical position the crosspiece 46 and platform 44 will be at the desired height and slope for supporting the user's feet during defecation, FIGS. 2, 4, and 10.

One end of a flexible wire segment 28 is attached to the back of each of the vertical swinging support struts 36 at about the longitudinal middle of the struts. The other end of each of the flexible wire segments 28 is attached or tied to a stiff wire segment 80, FIG. 4. The stiff wire segment 80 runs up along each lever 20 and 22 from its lower end to the spring activated trigger assembly 26 attached to the levers 20 and 22 just below the handles, 24 and 30.

When the platform 44 is in the original horizontal position resting on the floor, the vertical swinging support struts 36 are also resting on the floor pointing back alongside the toilet base 102. In this position, there is slack in each flexible wire segment 28, FIG. 4. However, when the platform is raised the vertical swinging support struts 36 deploy from the lever-crosspiece position downwards to a vertical position orthogonal to the floor surface, and the limited length of flexible wire segments 28 become taught, FIG. 4.

When the flexible wire segments 28 are taught, gripping the spring activated trigger assembly 26 pulls the stiff wire segments 80 back which in turn pulls the flexible wire segments 28 back, once toilet use has ended. These actions allow the vertical swinging support struts 36 to swing back, provided the bottom ends of the vertical swinging support struts 36 are not contacting the floor. As the vertical swinging support struts 36 swing back and the platform 44 is lowered, the bottoms of the vertical swinging support struts 36 slide back along the floor until the platform 44 reaches its original position resting on the floor, FIG. 4, and the vertical swinging support struts 36 are likewise resting on the floor.

The body support and positioning apparatus and system for seated-position toilet use 10 does not interfere with raising and lowering the toilet seat 104 nor the top cover.

Fastening assembly hardware, such as a standard threaded bolt and nut, or similar fasteners, or a pin fastener are sufficient to secure all fulcrum points, 40 and 42, 56, and 90, while providing the required range of motion for levers 20 and 22 moveably attached thereto, while securing the levers within their respective stanchion supports.

An embodiment of the body support and positioning apparatus and system for seated-position toilet use 10 provides a shorter length of platform 44 or no platform 44. For these embodiments, parallel levers 20 and 22 structure is adequately supported by the crosspiece 46 without a platform 44 (not shown). The user could put his feet on the bottom edge of the crosspiece 46 after initially sitting down.

These embodiments would further reduce any tripping hazard presented by the lower positioned platform 44. The crosspiece 46 could have cutouts just above bottom edge (not shown) so that the user's heels could recess into the cutouts right after he initially sits down.

An embodiment of the body support and positioning apparatus and system for seated-position toilet use 10 provides a single swinging strut vertical support element (not shown) that would be hingeably attached to the crosspiece 46 or the parallel levers 20 and 22 and providing a cutout to fit around the toilet base 102 when sliding back.

An embodiment of the body support and positioning apparatus and system for seated-position toilet use 10 provides curved parallel levers (not shown) providing downwards curved lower lever ends to engage the floor further back with respect to the toilet base 102 would reduce clutter near the toilet base 102 and further minimize any tripping hazard.

An embodiment of the body support and positioning apparatus and system for seated-position toilet use 10 provides a crosspiece affixed to the top of the levers and swinging struts or strut hinged to the bottom of the levers (not shown). Such an arrangement might simplify the manufacture of the unit.

While embodiments of the body support and positioning apparatus and system for seated-position toilet use 10 have been described and illustrated, it is to be understood that many changes, modifications and variations could be made to the apparatus and system of the present invention without departing from the scope or spirit of the disclosure, including the variety of alternative functioning elements of the apparatus.

I claim:

1. An assembly for body support and positioning for seated-position toilet use, the assembly comprising in combination:

a) two equal sized stanchions separately positioned on either side of a toilet base, each stanchion comprising a stanchion base, a stanchion vertical element orthogonally disposed to the stanchion base and comprising a stanchion vertical element bottom portion fixedly attached to the stanchion base and a top portion comprising a stanchion slot opening and a stanchion fulcrum aperture through stanchion sides on the stanchion slot opening;

b) two equal sized levers, each equal sized lever comprising an angled central element sized to be received into and held by the stanchion slot opening, and comprising a bottom portion, a top portion, a lever handle at the lever top portion, and an aperture midway on the angled central lever element of equal size as the stanchion fulcrum aperture and aligned to correspond with the stanchion fulcrum aperture, such that when each equal sized lever is received in its respective stanchion slot opening the two equal sized levers provide parallel orientation to each other with respect to the toilet base and positioned stanchions;

c) a platform affixed to the bottom portion of each of the two-parallel oriented equal sized levers;

d) a crosspiece affixed to the two-parallel oriented equal sized levers above the platform;

e) a fastener assembly through each stanchion fulcrum aperture and each corresponding equal sized lever aperture allowing for movement of each equal sized lever about the stanchion fulcrum aperture while securing each equal sized lever to the respective stanchion fulcrum aperture;

f) assembly to support each equal sized lever raised for body support and positioning for seated-position toilet use; and g) assembly for release of the assembly to support each equal sized lever once the toilet use is ended.

2. The assembly of claim 1, wherein each equal sized stanchion is adjustable, and further comprises a stanchion base, a stanchion first telescoping vertical element orthogonally disposed to the stanchion base and having a stanchion first telescoping vertical element bottom portion fixedly attached to the stanchion base, a stanchion second telescoping vertical element comprising a top portion comprising a stanchion slot opening and a stanchion fulcrum aperture through stanchion sides on the stanchion slot opening, and a releasable, locking assembly to permit the stanchion second telescoping vertical element to extend to a desired position and secure the stanchion second telescoping vertical element in the desired position above the stanchion first telescoping vertical element.

3. The assembly of claim 1, wherein each equal sized stanchion is adjustable, and further comprises an adjustable stanchion arm comprising an inside concave portion comprising a plurality of equally spaced gaps, an adjustable stanchion base comprising a first adjustable stanchion base hinged assembly and a second adjustable stanchion base hinged assembly, a locking pin comprising a first locking pin end sized to be received by and move about the first adjustable stanchion base hinged assembly and a second locking pin end sized to fit into and be received by one of the plurality of equally spaced gaps on the inside concave portion of the adjustable stanchion arm, to adjustably raise an adjustable stanchion fulcrum as the adjustable stanchion arm arcs upwards from the second adjustable stanchion base hinged assembly.

4. The assembly of claim 1, wherein the assembly to support each equal sized lever raised for body support and positioning for seated-position toilet use comprises a vertical swinging support strut sized to vertically support the platform and crosspiece at a desired height above a floor surface and hingeably attached to a backside of the crosspiece near a bottom corner of the crosspiece attachment to each equal sized lever, whereby as the equal sized lever handles are engaged by a user and pushed downwards, the bottoms of the equal sized levers arc upwards and the vertical swinging support strut deploys downwards from each crosspiece position to the floor surface by gravity to provide support orthogonal to the floor surface for the platform, crosspiece, and levers.

5. The assembly of claim 4, wherein the assembly for release of the assembly to support each lever once the toilet use is ended comprises a flexible wire segment comprising, in combination, a flexible wire first end and a flexible wire second end, the flexible wire first end attached to a back side of the vertical swinging support strut the near a longitudinal middle portion of the strut, the flexible wire second end attached to a stiff wire segment first end, a stiff wire segment second end connected a spring loaded trigger assembly attached to each lever just below the equal sized lever handle, whereby when the spring loaded trigger is engaged by a user, the stiff wire segment and flexible wire pull the vertical swinging support strut back from an orthogonal position to the floor surface allowing the platform, crosspiece, and equal sized levers to return to an original position with the platform resting on the floor surface and with the vertical swinging support strut also resting on the floor.

6. An assembly for body support and positioning for seated-position toilet use, the assembly comprising in combination:

a) two equal sized adjustable stanchions sized to be separately positioned on either side of a toilet base, each equal sized adjustable stanchion comprising an adjustable stanchion base, an adjustable stanchion first telescoping vertical element bottom portion orthogonally disposed and fixedly attached to the adjustable stanchion base and comprising an adjustable stanchion first telescoping vertical element top portion sized to receive an adjustable stanchion second telescoping vertical element orthogonally disposed to the adjustable stanchion base and comprising an adjustable stanchion second telescoping vertical element top portion comprising an adjustable stanchion second telescoping vertical element slot opening and an adjustable stanchion second telescoping vertical element fulcrum aperture through adjustable stanchion second telescoping vertical element sides on the adjustable stanchion second telescoping vertical element slot opening, and further comprising a fastening assembly to secure the adjustable stanchion telescoping second vertical element within and above the adjustable stanchion telescoping first vertical element top portion at a desired height for the adjustable stanchion second telescoping vertical element fulcrum;

b) two equal sized levers, each equal sized lever comprising an angled central element sized to be received into and held by the adjustable stanchion second telescoping vertical element slot opening, and comprising an equal sized lever bottom portion, an equal sized lever top portion, an equal sized lever handle at equal sized lever top portion, and an aperture midway on the equal sized lever angled central element of equal size as the adjustable stanchion telescoping second vertical element fulcrum aperture and aligned to correspond with the adjustable stanchion telescoping second vertical element fulcrum aperture, such that when each equal sized lever is received into an adjustable stanchion telescoping second vertical element slot opening, the two equal sized levers provide parallel orientation to each other with respect to the toilet base and the equal sized adjustable stanchions;

c) a platform affixed to the bottom portion of each of the two-parallel oriented equal sized levers;

d) a crosspiece affixed to the two-parallel oriented equal sized levers above the platform;

e) a fastener assembly through each adjustable stanchion telescoping second vertical element fulcrum aperture and corresponding equal sized lever aperture allowing for movement of the lever about the adjustable stanchion telescoping second vertical element fulcrum while securing the equal sized lever within the adjustable stanchion telescoping second vertical element fulcrum aperture;

f) assembly to support each equal sized lever raised for body support and positioning for seated-position toilet use; and g) assembly for release of the assembly to support each equal sized lever once the toilet use is ended.

7. The assembly of claim 6, wherein the assembly to support each lever raised for body support and positioning for seated-position toilet use comprises a vertical swinging support strut sized to vertically support the platform and crosspiece at a desired height above the floor and hingeably attached to a backside of the crosspiece near a bottom corner of the crosspiece attachment to each lever, whereby as the lever handles are engaged by a user and pushed downwards, the bottom of the levers arc upwards and vertical swinging support strut deploys from each lever-crosspiece position downwards to the floor by gravity to provide support orthogonal to the floor surface for the platform, crosspiece, and levers.

8. The assembly of claim 7, wherein the assembly for release of the assembly to support each lever once the toilet use is ended comprises a flexible wire segment comprising, in combination, a flexible wire first end and a flexible wire second end, the flexible wire first end attached to a back side of the vertical swinging support strut near a longitudinal middle portion of the strut, the flexible wire second end attached to a stiff wire segment first end, a stiff wire segment second end connected to a spring loaded trigger assembly attached to each lever just below the handle, whereby when the spring loaded trigger is engaged by a user, the stiff wire segment and flexible wire pull the vertical swinging support strut back from an orthogonal position to the+ floor allowing the platform, crosspiece, and levers to return to an original position with the platform resting on a floor surface and the vertical swinging support strut resting on the floor surface.

9. An assembly for body support and positioning for seated-position toilet use, the assembly comprising in combination:

a) two equal sized adjustable stanchions sized to be separately positioned on either side of a toilet base, each stanchion comprising an adjustable stanchion arm comprising an inside concave portion comprising a plurality of equally spaced gaps, and further comprising an adjustable stanchion arm fulcrum and an adjustable stanchion arm slot opening, an adjustable stanchion base comprising a first adjustable stanchion base hinged assembly and a second adjustable stanchion base hinged assembly, a locking pin comprising a first locking pin end sized to be received by and move about the first adjustable stanchion base hinged assembly and a second locking pin end sized to fit into and be received by one of the plurality of equally spaced gaps on the inside concave portion of the adjustable stanchion arm, to adjustably raise an adjustable stanchion fulcrum as the adjustable stanchion arm arcs upwards from the second adjustable stanchion base hinged assembly;

b) two equal sized levers, each lever comprising an angled central element sized to be received into and held by the adjustable stanchion arm slot opening, and comprising a bottom portion, a top portion, a lever handle at the top of the lever central element, and an aperture midway on the angled central lever element of equal size as the adjustable stanchion arm fulcrum aperture and aligned to correspond with the adjustable stanchion arm fulcrum aperture, such that when each lever is received into an adjustable stanchion arm slot opening, the levers provide parallel orientation to each other with respect to the toilet base and the adjustable stanchions;

c) a platform affixed to the bottom portion of each of the parallel oriented levers;

d) a crosspiece affixed to the parallel oriented levers above the platform;

e) a fastener assembly through each adjustable stanchion arm fulcrum aperture and corresponding lever aperture allowing for movement of the lever about the stanchion fulcrum and securing the lever within the stanchion fulcrum aperture;

f) assembly to support each lever raised for body support and positioning for seated-position toilet use; and g) assembly for release of the assembly to support each lever once the toilet use is ended.

10. The assembly of claim 9, wherein the assembly to support each lever raised for body support and positioning for seated-position toilet use comprises a vertical swinging support strut sized to vertically support the platform and crosspiece at a desired height above a floor surface and hingeably attached to a backside of the crosspiece near a bottom corner of the crosspiece attachment to each equal sized lever, whereby as the equal sized lever handles are engaged by a user and pushed downwards, the bottom of each equal sized lever arc upwards and the vertical swinging support strut deploys downwards from each equal sized lever-crosspiece position to the floor by gravity to provide support orthogonal to the floor surface for the platform, crosspiece, and levers.

11. The assembly of claim 10, wherein the assembly for release of the assembly to support each lever once the toilet use is ended comprises a flexible wire segment comprising, in combination, a flexible wire first end and a flexible wire second end, the flexible wire first end attached to a back side of the vertical swinging support strut near a longitudinal middle portion of the strut, the flexible wire second end attached to a stiff wire segment first end, a stiff wire segment second end connected to a spring loaded trigger assembly attached to each equal sized lever just below the handle, whereby when the spring loaded trigger is engaged by a user, the stiff wire segment and flexible wire pull the vertical swinging support strut back from an orthogonal position to the floor surface allowing the platform, crosspiece, and levers to return to an original position with the platform resting on the floor surface and the vertical swinging support strut folded resting on the floor surface.

* * * * *